US011450276B2

(12) United States Patent
Kawachi

(10) Patent No.: US 11,450,276 B2
(45) Date of Patent: Sep. 20, 2022

(54) DISPLAY DEVICE AND METHOD OF CONTROLLING PIXEL CIRCUIT

(71) Applicant: WUHAN TIANMA MICRO-ELECTRONICS CO., LTD., Wuhan (CN)

(72) Inventor: Genshiro Kawachi, Kanagawa (JP)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/341,733

(22) Filed: Jun. 8, 2021

(65) Prior Publication Data

US 2021/0383754 A1 Dec. 9, 2021

(30) Foreign Application Priority Data

Jun. 9, 2020 (JP) ..... JP2020-100388

(51) Int. Cl.
*G09G 3/3233* (2016.01)

(52) U.S. Cl.
CPC ..... *G09G 3/3233* (2013.01); *G09G 2330/02* (2013.01)

(58) Field of Classification Search
CPC ..... G09G 3/3233; G09G 2330/02
See application file for complete search history.

(56) References Cited

U.S. PATENT DOCUMENTS

| | | | | |
|---|---|---|---|---|
| 11,054,710 | B2 * | 7/2021 | Kusunoki | G09G 3/36 |
| 2003/0107565 | A1 * | 6/2003 | Libsch | G09G 3/3233 345/211 |
| 2006/0022305 | A1 * | 2/2006 | Yamashita | G09G 3/2014 257/565 |
| 2008/0197784 | A1 * | 8/2008 | Benzarti | G09G 3/3233 315/169.3 |
| 2020/0372853 | A1 * | 11/2020 | Park | G09G 3/3233 |

FOREIGN PATENT DOCUMENTS

| | | |
|---|---|---|
| JP | 08211368 | 8/1996 |
| JP | 2005-321684 | 11/2005 |
| JP | 2007-081094 | 3/2007 |

* cited by examiner

*Primary Examiner* — Jeff Piziali
(74) *Attorney, Agent, or Firm* — Nixon & Vanderhye

(57) ABSTRACT

A display device includes a pixel circuit and a control circuit configured to control the pixel circuit. The pixel circuit includes a light-emitting element, and a driving thin-film transistor configured to control the amount of current to the light-emitting element. The control circuit is configured to apply a stress current higher than a maximum current for the light-emitting element to display images to the driving thin-film transistor but not to supply current to the light-emitting element in a period other than light-emitting periods of the light-emitting element to display an image.

10 Claims, 12 Drawing Sheets

DISPLAY DEVICE AND METHOD OF CONTROLLING PIXEL CIRCUIT

CROSS-REFERENCE TO RELATED APPLICATIONS

This non-provisional application claims priority under 35 U.S.C. § 119(a) on Patent Application No. 2020-100388 filed in Japan on Jun. 9, 2020, the entire content of which is hereby incorporated by reference.

BACKGROUND

This disclosure relates to a display device and a method of controlling a pixel circuit.

An organic light-emitting diode (OLED) element is a current-driven self-light-emitting element and therefore, does not need a backlight. In addition to this, the OLED element has advantages for achievement of low power consumption, wide viewing angle, and high contrast ratio; it is expected to contribute to development of flat panel display devices.

An active-matrix (AM) OLED display device includes transistors for selecting pixels and driving transistors for supplying electric current to the pixels. The transistors in an OLED display device are thin-film transistors (TFTs); particularly, low-temperature polysilicon (LTPS) TFTs or oxide semiconductor TFTs are used.

The TFTs have variations in their threshold voltage and charge mobility. Since the driving transistors determine the light emission intensity of the OLED display device, their variations in electrical characteristics could cause a problem. Hence, a typical OLED display device includes a correction circuit for compensating for the variations and shifts of the threshold voltage of the driving transistors.

SUMMARY

An aspect of this disclosure is a display device including a pixel circuit and a control circuit configured to control the pixel circuit. The pixel circuit includes a light-emitting element, and a driving thin-film transistor configured to control the amount of current to the light-emitting element. The control circuit is configured to apply a stress current higher than a maximum current for the light-emitting element to display images to the driving thin-film transistor but not to supply current to the light-emitting element in a period other than light-emitting periods of the light-emitting element to display an image.

An aspect of this disclosure is a method of controlling a pixel circuit including a light-emitting element and a driving thin-film transistor configured to control the amount of current to the light-emitting element. The method includes: applying a stress current higher than a maximum current for the light-emitting element to display images to the driving thin-film transistor but not supplying current to the light-emitting element in a period other than light-emitting periods of the light-emitting element to display an image.

It is to be understood that both the foregoing general description and the following detailed description are exemplary and explanatory and are not restrictive of this disclosure.

EMBODIMENTS

Figure 1:
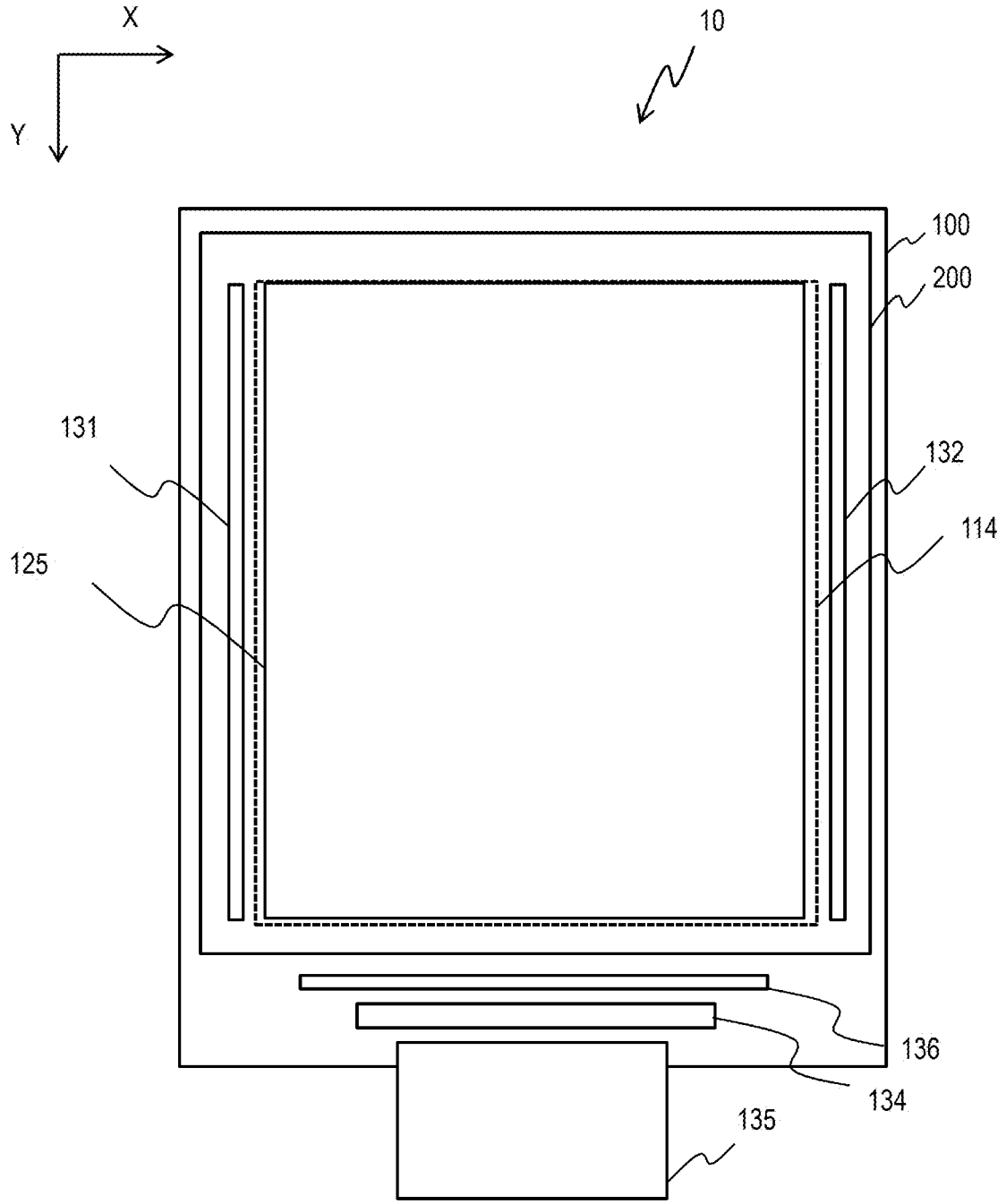
FIG. 1 schematically illustrates a configuration example of an OLED display device of a display device.

Hereinafter, embodiments will be described specifically with reference to the accompanying drawings. Elements common to the drawings are denoted by the same reference signs and each element in the drawings may be exaggerated in size and/or shape for clear understanding of the description.

Disclosed in the following is a technique to remedy the drift of driving current in a self-light-emitting display device utilizing light-emitting elements that emit light in response to the driving current, like an organic light-emitting diode (OLED) display device. The technique reduces the brightness change in the self-light-emitting display device.

Flexible OLED display devices fabricated on a resin film, particularly a polyimide film, exhibit significant initial brightness change such that the brightness decreases by several percent in a few hours after activation. Comparative evaluation of thin-film transistors (TFTs) on a flexible substrate and TFTs on a glass substrate revealed that a large current drift occurs in the TFTs on a flexible substrate that keep receiving current bias, compared to the TFTs on a glass substrate. It is presumed that this is caused by the charges originating from the moisture in the resin film. This current drift in driving TFTs causes initial brightness change to an OLED display device.

The embodiments in this description diminish the current drift of a driving TFT by applying stress current to the driving TFT. The stress current can be higher than the current (maximum current) for the highest brightness of the OLED element in displaying images. The stress current deteriorates the characteristics of the driving TFT and reduces the current allowed to flow through the driving TFT. This restricts the increase in current in the driving TFT caused by the charges from the lower layer. The features of the embodiments in this description are applicable to self-light-emitting display devices of the kinds other than the OLED display device.

Configuration of Display Device

FIG. 1 schematically illustrates a configuration example of an OLED display device 10 of a display device. The OLED display device 10 includes a thin-film transistor (TFT) substrate 100 on which OLED elements (light-emitting elements) are provided and a thin-film encapsulation 200 for encapsulating the OLED elements.

In the periphery of a cathode electrode region 114 outer than the display region (also called an active area) 125 of the TFT substrate 100, a scanning circuit 131, an emission control circuit 132, a driver IC 134, and a demultiplexer 136 are provided. The driver IC 134 is connected to the external devices via flexible printed circuits (FPC) 135. The scanning circuit 131 drives selection lines on the TFT substrate 100. The emission control circuit 132 drives emission control lines. The scanning circuit 131, the emission control circuit 132, the driver IC 134, and the demultiplexer 136 are included in control circuits for controlling the OLED panel.

The driver IC 134 is mounted with an anisotropic conductive film (ACF), for example. The driver IC 134 provides power and timing signals (control signals) to the circuits 131 and 132 and further, provides a data signal to the demultiplexer 136.

The demultiplexer 136 outputs output of one pin of the driver IC 134 to d data lines in series (d is an integer more than 1). The demultiplexer 136 changes the output data line for the data signal from the driver IC 134 d times per scanning period to drive d times as many data lines as output pins of the driver IC 134.

The display region 125 includes a plurality of OLED elements (pixels) and a plurality of pixel circuits for controlling light emission of the plurality of pixels. In an example of a color OLED display device, each OLED element emits light in one of the colors of red, blue, and green. The plurality of pixel circuits constitute a pixel circuit array.

As will be described later, each pixel circuit includes a driving TFT (driving transistor) and a storage capacitor for storing signal voltage to determine the driving current of the driving TFT. The data signal transmitted by a data line is corrected and stored to the storage capacitor. The voltage of the storage capacitor determines the gate voltage (Vgs) of the driving TFT. The corrected data signal changes the conductance of the driving TFT in an analog manner to supply a forward bias current corresponding to the light emission level to the OLED element. The features of the embodiments are applicable to display devices with pixel circuits including no correction circuit.

Current Instability in TFT

Figure 2:
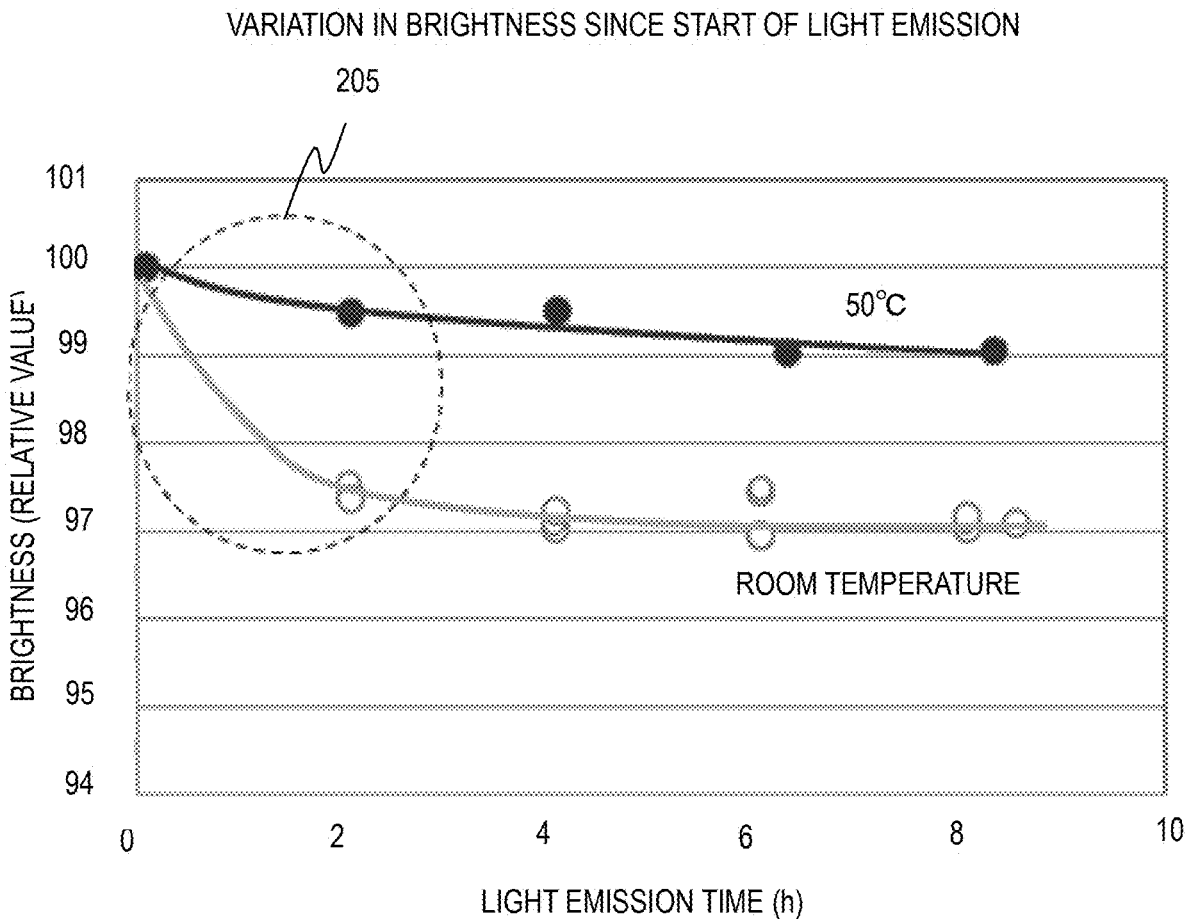
FIG. 2 provides measurement results to show the variation in brightness of an OLED display device on a polyimide substrate over time after activation.

The OLED display devices 10 in the embodiments of this description heat the driving TFTs to reduce the brightness change (initial brightness change) after their activation. FIG. 2 provides measurement results to show the variation in brightness of an OLED display device on a polyimide substrate over time after activation. Specifically, FIG. 2 provides temporal variation in relative brightness when the environmental temperature was 50° C. and temporal variation in relative brightness when the environmental temperature was room temperature. The X-axis represents the relative brightness and the Y-axis represents the time elapsed since activation.

As encircled by a broken line 205 in FIG. 2, the brightness of the OLED display device 10 drops in a few hours after activation. When the environmental temperature is 50° C., the initial brightness drop is small; however, when the environmental temperature is room temperature, the drop is large. The brightness after two hours from activation is lower than the brightness immediately after the activation by almost 3%. When a TFT on a polyimide substrate keeps receiving current bias, current drift occurs. This current drift causes initial brightness drop to the OLED display device.

Figure 3:
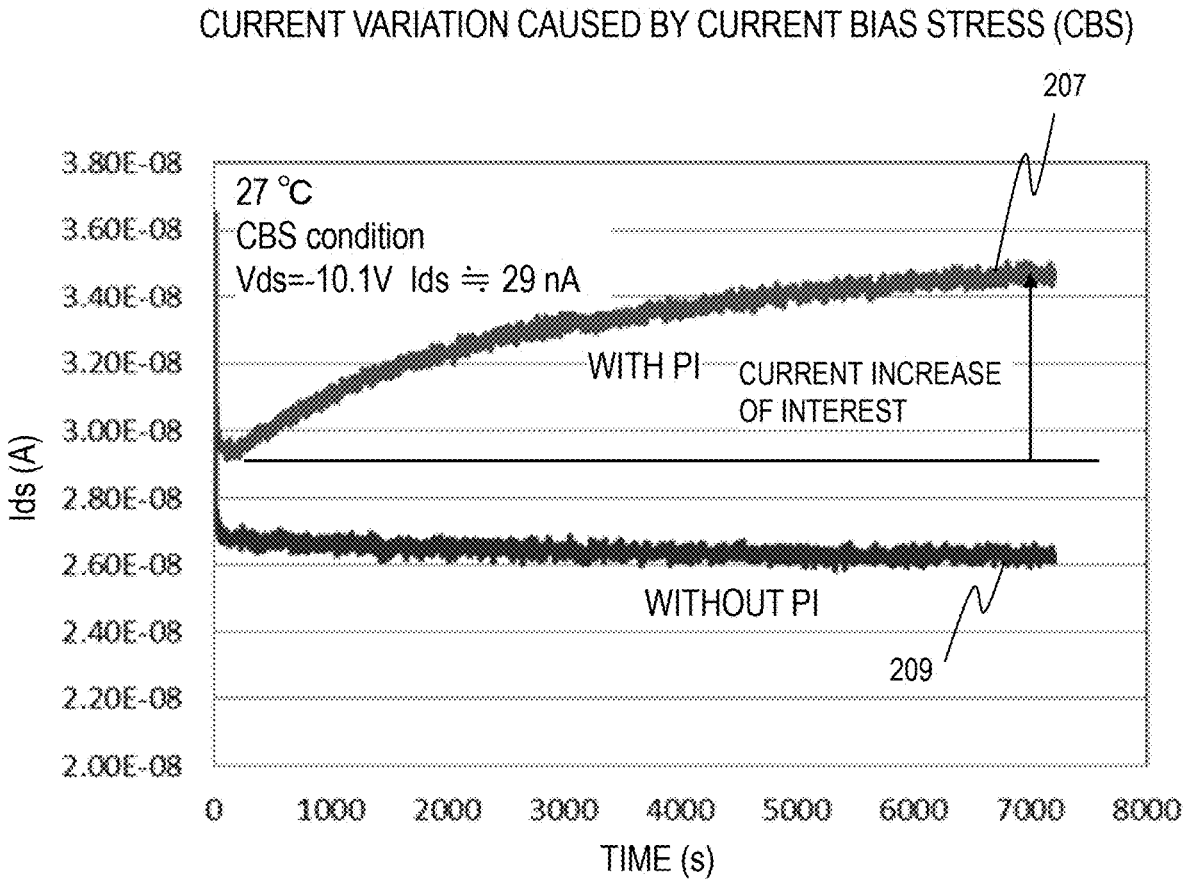
FIG. 3 provides measurement results to explain the variation in current of a TFT on a polyimide substrate caused by current bias stress (CBS)

FIG. 3 provides measurement results to explain the variation in current of a TFT on a polyimide substrate caused by a current bias stress (CBS). Specifically, FIG. 3 provides current variation 207 of a TFT on a polyimide film provided on a glass substrate and current variation 209 of a TFT fabricated on a glass substrate with no polyimide film. The X-axis represents the time elapsed since supply of the current is started and the Y-axis represents the drain-source current Ids. The environmental temperature was 27° C. and the drain-source voltage Vds was −10.1 V. The drain-source current Ids when supply of the current was started was approximately 29 nA.

The TFT on a glass substrate with no polyimide film does not show significant change (instability) in the drain-source current Ids (the graph 209). However, the TFT on a polyimide layer shows significant increase in the drain-source current Ids.

As noted from these measurement results, when a polyimide layer is not provided under the TFT, the instability of the drain-source current (increase in Ids) is not observed. Accordingly, it could be understood that the polyimide layer causes the instability of the current (increase in Ids) in a TFT. This is presumed to be because an electric field applied to a polyimide layer that has absorbed moisture induces negative charges in the polyimide film to shift the threshold voltage Vth of the TFT.

The correction circuit (Vth correction circuit) in a pixel circuit determines the gate-source voltage of the driving TFT corresponding to the video signal so that the variation in Vth of the driving TFT will be compensated for. The correction circuit corrects the shifted Vth in consideration of the increase in Ids current; therefore, the gate-source voltage of the driving TFT corresponding to the video signal is lowered and the current supplied to the OLED element decreases. As a result, the brightness of the OLED display device 10 drops. In fact, the simulation result of a pixel circuit including a correction circuit indicates that increase in the drain-source current of the driving TFT by 20% results in decrease in the driving current for the OLED element by approximately 2%.

Figure 4:
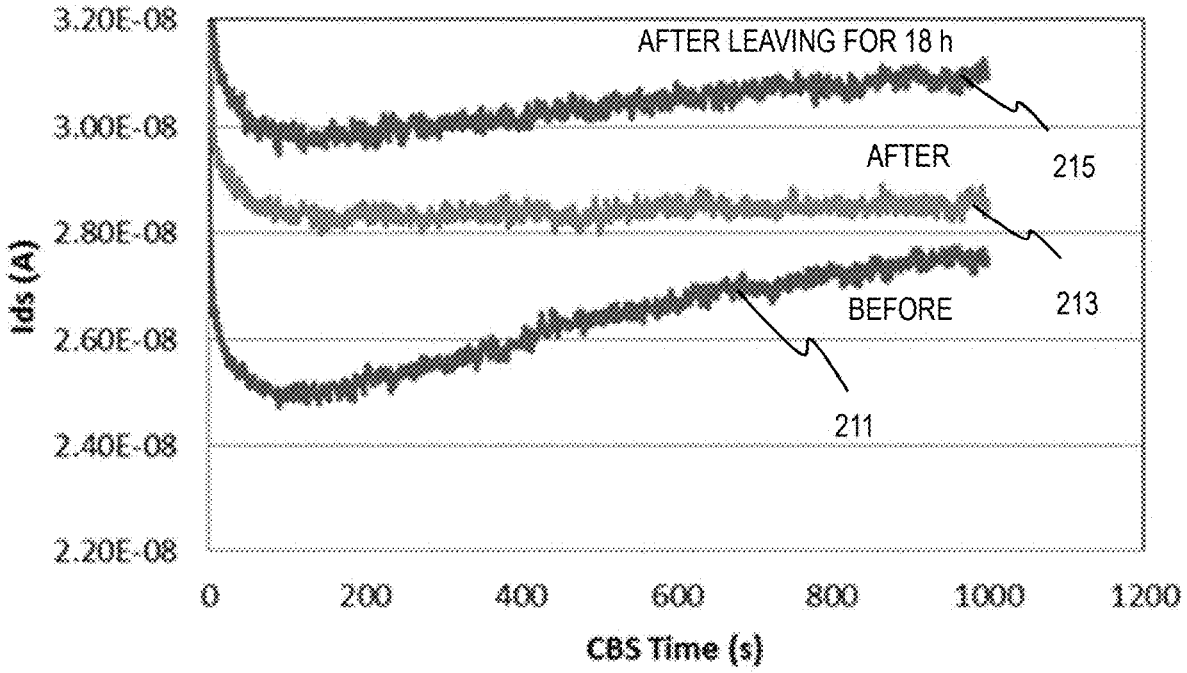
FIG. 4 is a chart for explaining the effect of the stress current to the TFT on the current instability.

The inventor's research revealed that the current instability can be diminished temporarily by applying stress current to the TFT. FIG. 4 is a chart for explaining the effect of the stress current to the TFT on the current instability. In the chart, the graph 211 represents temporal variation in drain-source current of a TFT in the initial state before the stress current is supplied. The graph 213 represents temporal variation in drain-source current of the TFT after the stress current is supplied to the TFT. The graph 215 represents temporal variation in drain-source current of the TFT left for 18 hours after the stress current is supplied.

As understood from the graph 213, the current instability can be eliminated by applying stress current to the TFT. However, as indicated by the graph 215, the current instability reappears when the TFT is left for some time after the stress current is supplied. Accordingly, applying the stress current in manufacturing an OLED display device 10 is not a sufficient solution to the current instability of the TFTs. It is important to incorporate a function to apply stress current to the driving TFTs into the OLED display device 10.

Configuration of Pixel Circuit

Figure 5:
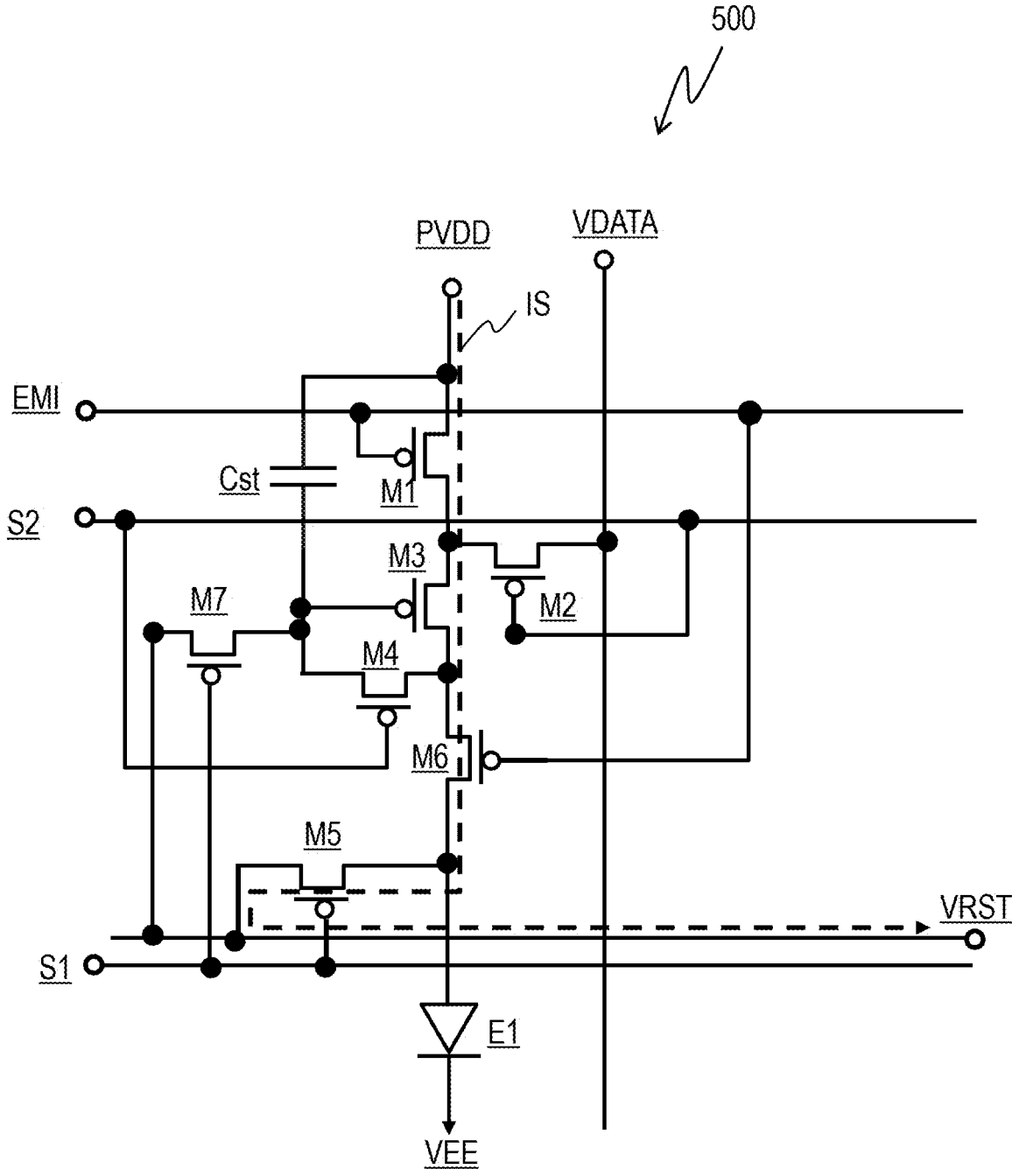
FIG. 5 illustrates a configuration example of a pixel circuit.

FIG. 5 illustrates a configuration example 500 of a pixel circuit in an embodiment. The pixel circuit 500 applies stress current to the driving transistor. The stress current reduces the initial drop of the brightness after activation of the OLED display device 10. The reduction of the current instability in the driving transistor by stress current is applicable to pixel circuits different from this example, inclusive of pixel circuits that do not have a threshold voltage correction function.

The pixel circuit 500 corrects the data signal supplied from the driver IC 134 and controls the light emission of the OLED element with the corrected data signal. The pixel circuit 500 includes seven transistors (TFTs) M1 to M7 each having a gate, a source, and a drain. In this example, the transistors M1 to M7 are p-type TFTs. The reduction of current instability by stress current in this embodiment is applicable to pixel circuits including n-type semiconductor transistors or oxide semiconductor transistors.

The transistor M3 is a driving transistor for controlling the amount of current to an OLED element E1. The driving transistor M3 controls the amount of current to be supplied from a power line PVDD to the OLED element E1 in accordance with the voltage stored in a storage capacitor Cst. The cathode of the OLED element E1 is connected with a cathode power line VEE. The storage capacitor Cst stores the gate-source voltage (also simply referred to as gate voltage) of the driving transistor M3.

The transistors M1 and M6 control whether to make the OLED element E1 emit light. The source of the transistor M1 is connected with the power line PVDD to switch ON/OFF the current supply to the driving transistor M3 connected with the drain of the transistor M1. The source of the transistor M6 is connected with the drain of the driving transistor M3 to switch ON/OFF the current supply to the OLED element E1 connected with the drain of the transistor M6. The transistors M1 and M6 are controlled by an emission control signal input to their gates from an emission control line EMI. The transistors M1 and M6 further work to apply stress current to the driving transistor M3.

The transistor M5 works to supply a reset potential to the anode of the OLED element E1. When the transistor M5 is turned ON by a selection signal from a selection line S1, the transistor M5 supplies a reset potential from a reset line VRST to the anode of the OLED element E1. The transistor M5 further works to apply stress current to the driving transistor M3.

The transistor M7 controls whether to supply the reset potential to the gate of the driving transistor M3. When the transistor M7 is turned ON by a selection signal input from the selection line S1 to the gate, the transistor M7 supplies the reset potential from the reset line VRST to the gate of the driving transistor M3. The reset potential for the anode of the OLED element E1 can be different from the reset potential for the gate of the driving transistor M3.

The transistor M2 is a selection transistor for selecting the pixel circuit 500 to be supplied with a data signal. The gate potential of the transistor M2 is controlled by a selection signal supplied from a selection line S2. When the selection transistor M2 is ON, the selection transistor M2 supplies a data signal supplied through a data line VDATA to the gate (storage capacitor Cst) of the driving transistor M3.

In this example, the selection transistor M2 (the source and the drain thereof) is connected between the data line VDATA and the source of the driving transistor M3. Further, the transistor M4 is connected between the drain and the gate of the driving transistor M3.

The transistor M4 works to correct the threshold voltage of the driving transistor M3. The gate potential of the transistor M4 is controlled by a selection signal supplied from the selection line S2. When the transistor M4 is ON, the driving transistor M3 operates as a diode-connected transistor. The data signal from the data line VDATA is supplied to the storage capacitor Cst via the channels (the sources and the drains) of the selection transistor M2, the driving transistor M3, and the transistor M4 that are ON.

The storage capacitor Cst stores a data signal (gate-source voltage) corrected depending on the threshold voltage Vth of the driving transistor M3. In the example of FIG. 5, one of the electrodes of the storage capacitor Cst is connected with the gate of the driving transistor M3 and the other electrode is connected with the power line PVDD.

As illustrated in FIG. 5, the stress current IS is supplied from the power line PVDD to the driving transistor M3 via the transistor M1. In this example, the stress current IS is higher than the current (maximum current) for the highest brightness of the OLED element E1 in displaying images. The stress current IS that has passed through the driving transistor M3 flows through the transistors M6 and M5 and enters the reset line VRST. As will be described later, the stress current IS is supplied in a resetting period of the driving transistor M3 and the OLED element E1. This configuration enables efficient supply of the stress current. The stress current can be either constant or varied.

Control of Pixel Circuit

Figure 6:
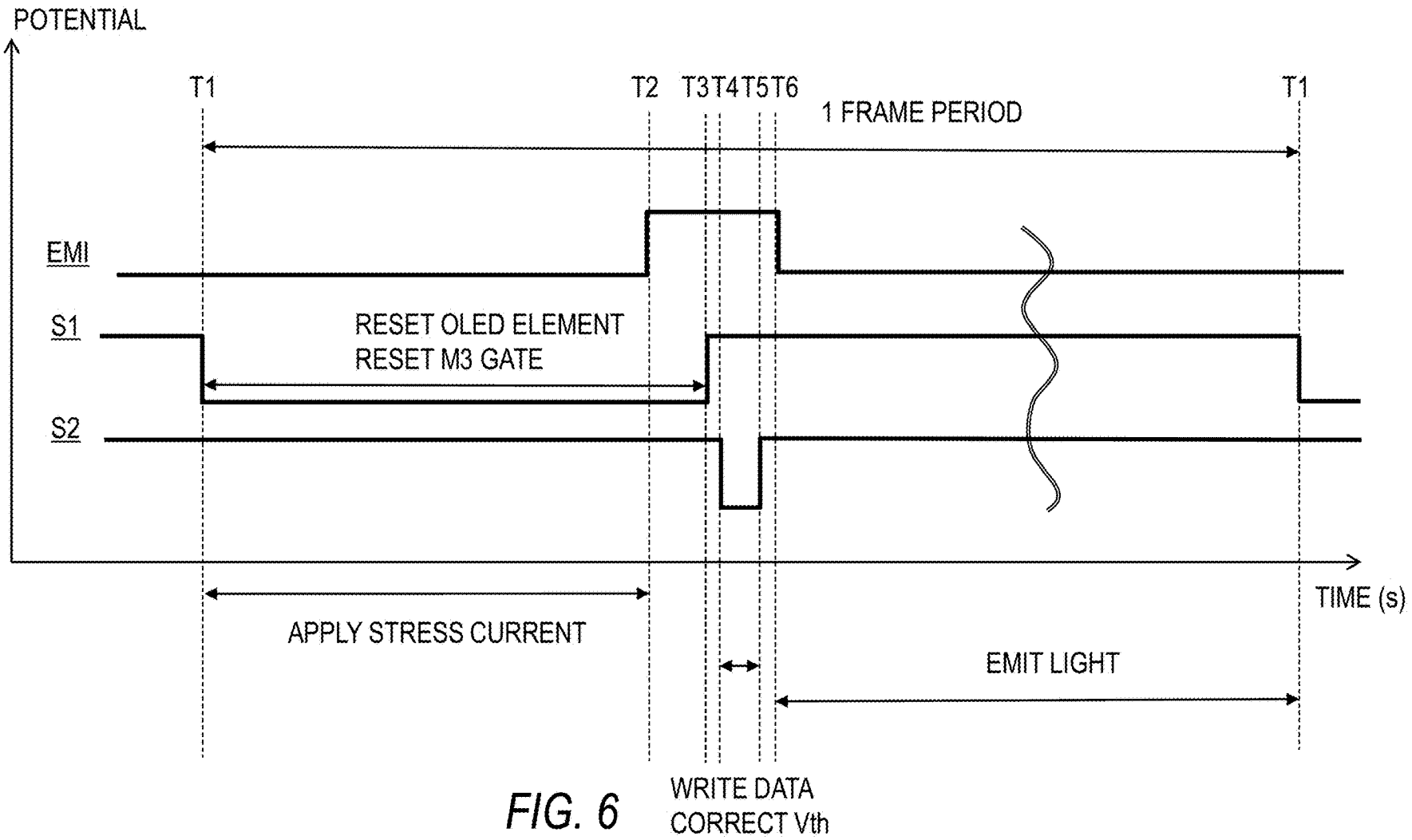
FIG. 6 is a timing chart of the signals for controlling a pixel circuit in one frame period.

FIG. 6 is a timing chart of the signals for controlling the pixel circuit 500 in FIG. 5 in one frame period. FIG. 6 is a timing chart to select the N-th row and write a data signal to the pixel circuit 500 in one frame period. Hereinafter, the signals are identified by the same reference signs as the lines for transmitting the signals for the simplicity of explanation. Specifically, FIG. 6 illustrates the variation of the signal (emission control signal EMI) on the emission control line EMI, the signal (selection signal S1) on the selection line S1, and the signal (selection signal S2) on the selection line S2 during one frame period.

At a time T1, the selection signal S1 changes from High to Low. In response to this change, the transistors M5 and M7 are turned ON at the time T1. The emission control signal EMI at the time T1 is Low. Accordingly, the transistors M1 and M6 are ON. The selection signal S2 is High and therefore, the transistors M2 and M4 are OFF.

The above-described state continues from the time T1 to a time T2. Since the transistor M7 is ON, the reset potential is supplied to the gate of the driving transistor M3. Since the transistor M5 is ON, the reset potential is also supplied to the anode of the OLED element E1. Since the transistors M1, M6, and M5 are ON, the stress current IS flows from the power line PVDD to the reset line VRST via the transistors M1, M3, M6, and M5. Since the transistor M5 is ON, the stress current IS does not flow into the OLED element E1.

At the time T2, the emission control signal EMI changes from Low to High. In response to this change, the transistors M1 and M6 are turned OFF to stop the stress current IS. The selection signal S1 is still Low and the selection signal S2 is still High. Accordingly, the states of the other transistors are maintained. As described above, the period from the time T1 to the time T2 is a stress current application period, during which the stress current IS flows through the driving transistor M3.

At a time T3, the selection signal S1 changes from Low to High. In response to this change, the transistors M5 and M7 are turned OFF. The supply of the reset potential to the gate of the driving transistor M3 and the OLED element E1 stops. The emission control signal EMI and the selection signal S2 are still High. Accordingly, the transistors M1, M2, M4, and M6 are still OFF. As described above, the period from the time T1 to the time T3 is a resetting period; the OLED element and the driving transistor M3 are supplied with the reset potential.

At a time T4, the selection signal S2 changes from High to Low. In response to this change, the transistors M2 and M4 are turned ON. Then, a data signal is supplied from the data line VDATA to the storage capacitor Cst via the transistors M2, M3, and M4. The voltage to be written to the storage capacitor Cst is a voltage after the correction to the threshold voltage Vth of the driving transistor M3 is incorporated in the data signal. In the period from the time T4 to a time T5, data signal write to the pixel circuit 500 and Vth correction are performed.

At the time T5, the selection signal S2 changes from Low to High. The emission control signal EMI and the selection signal S1 at the time T5 are High. In response to the change of the selection signal S2, the transistors M2 and M4 are turned OFF. The transistors M1, M2, and M4 to M7 are OFF. These states of the control signals and the transistors are maintained from the time T5 to a time T6.

At the time T6, the emission control signal EMI changes from High to Low, so that the transistors M1 and M6 are turned ON. The selection signals S1 and S2 are High and accordingly, the transistors M2, M4, M5, and M7 are kept be OFF. The driving transistor M3 controls the driving current to be supplied to the OLED element E1 based on the corrected data signal stored in the storage capacitor Cst. This means that the OLED element E1 emits light.

The control method described with reference to FIG. 6 applies the stress current to the driving transistor M3 in a period other than the light emitting period in one frame period. More specifically, the method applies the stress current to the driving transistor M3 in the resetting period for the driving transistor M3 and the OLED element E1. In the next example described in the following, the driver IC 134 has two control modes for the OLED panel including a TFT substrate 100 and a thin-film encapsulation 200. The first control mode is a stress application mode described with reference to FIG. 6 and the second control mode is a normal mode not to apply the stress current to the driving transistor.

Figure 7:
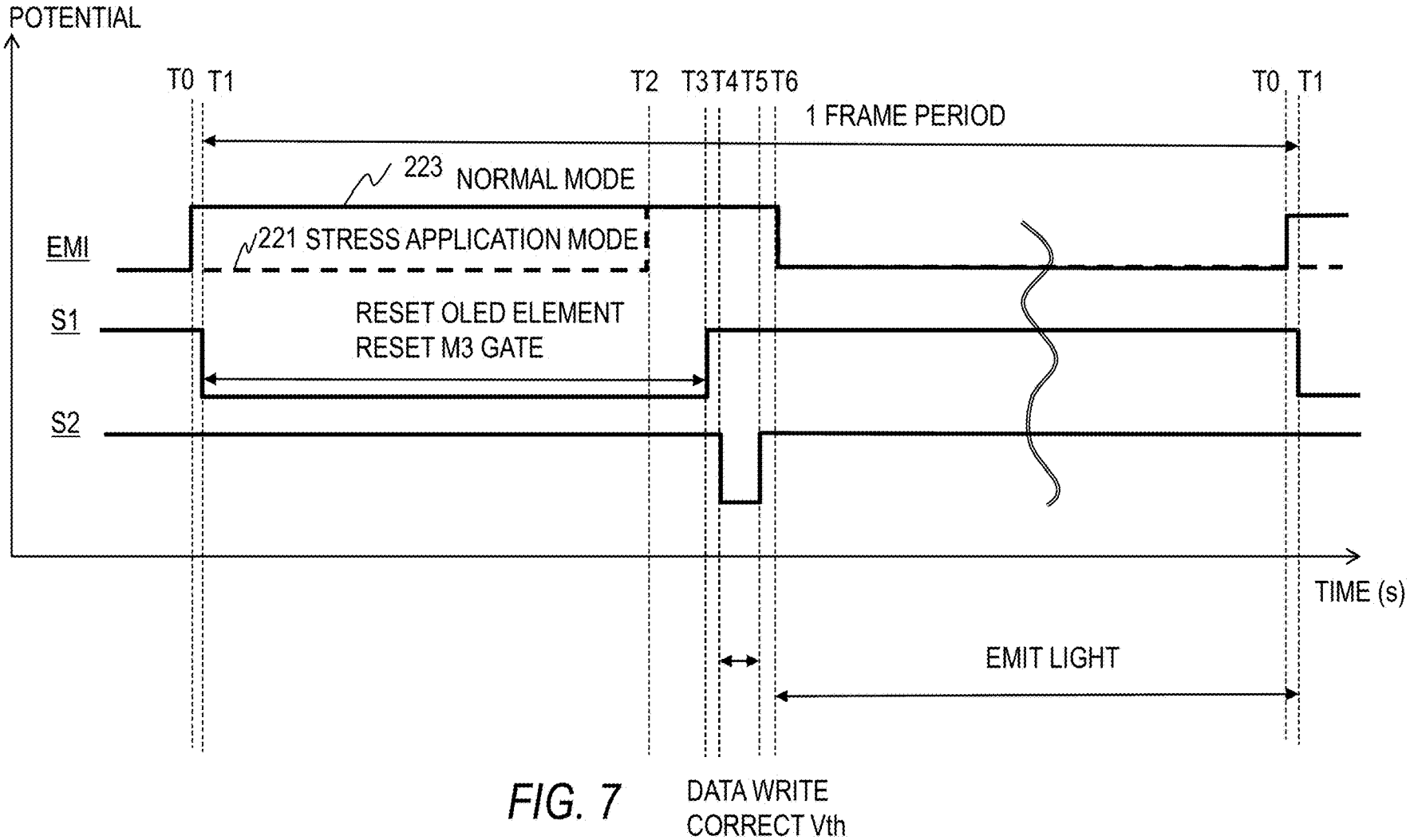
FIG. 7 is a timing chart illustrating the temporal variation of the control signals under a stress application mode and the temporal variation of the control signals under a normal mode.

FIG. 7 is a timing chart illustrating the temporal variation of the control signals S1, S2, and EMI under the stress application mode and the temporal variation of the control signals S1, S2, and EMI under the normal mode. The control signals under the stress application mode vary as described with reference to FIG. 6. The selection signals S1 and S2 vary in the same manner between the stress application mode and the normal mode.

The emission control signal EMI varies differently between the stress application mode and the normal mode. FIG. 7 includes temporal variation 221 of the emission control signal EMI in the stress application mode and temporal variation 223 of the emission control signal EMI in the normal mode.

In the normal mode, the emission control signal EMI changes from Low to High at a time T0, which is immediately before the time T1. In response to this change, the transistors M1 and M6 are turned OFF. Since the transistor M1 is OFF, the stress current that flows from the power line PVDD to the driving transistor M3 via the transistor M1 in the stress application mode is blocked by the transistor M1. The emission control signal EMI is maintained High until the time T6. As understood from this description, the stress current is stopped without being supplied to the driving transistor M3 in the normal mode.

Figure 8:
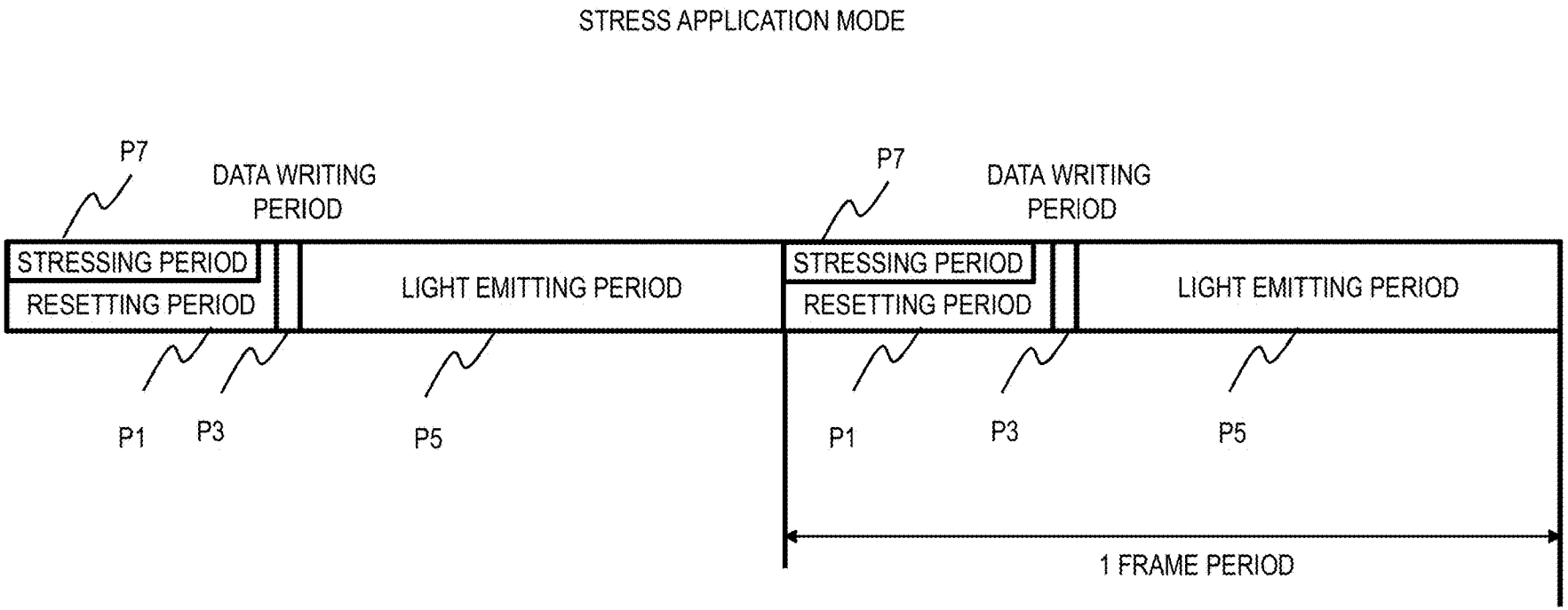
FIG. 8 schematically illustrates transition of operation in the stress application mode.

FIG. 8 schematically illustrates transition of operation in the stress application mode. As described with reference to FIG. 6, one frame period includes a resetting period P1 in which the reset potential is supplied to the driving transistor and the OLED element, a stressing period P7 in which the stress current is applied to the driving transistor, a data writing period P3 in which data is written to the storage capacitor Cst, and a light emitting period P5. The stressing period P7 overlaps the resetting period P1. The stressing period P7 does not need to be included in the resetting period P1.

Figure 9:
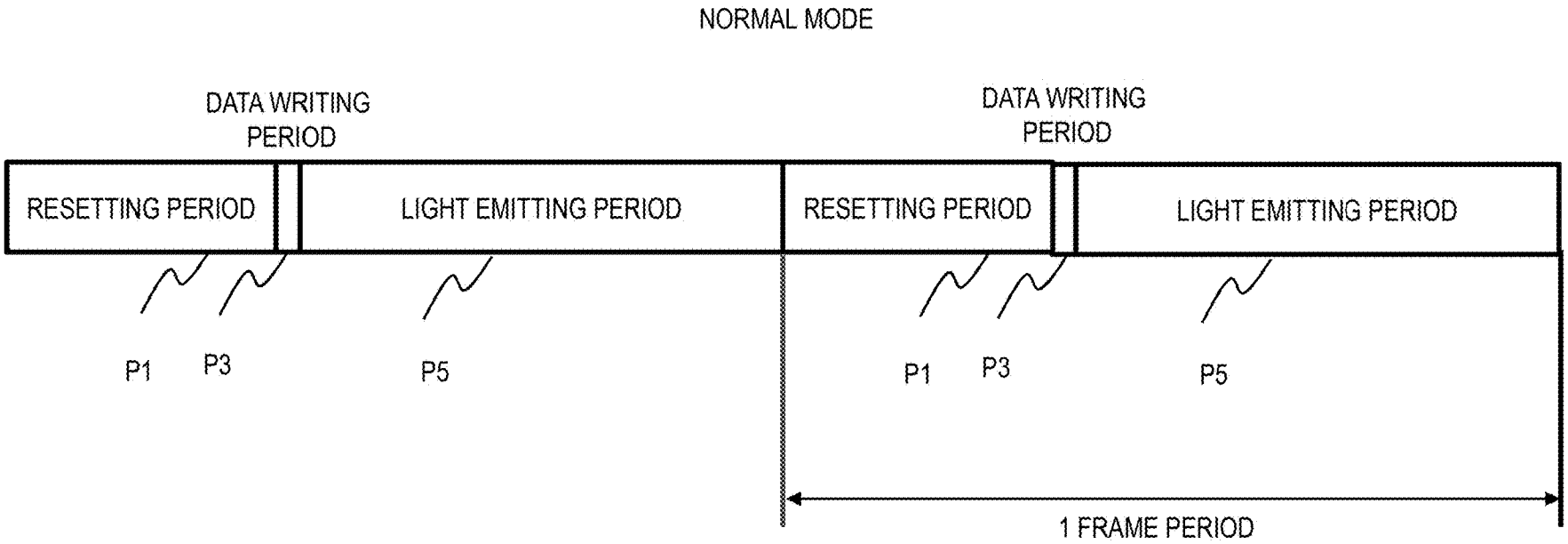
FIG. 9 schematically illustrates transition of operation in the normal mode.

FIG. 9 schematically illustrates transition of operation in the normal mode. As described with reference to FIGS. 6 and 7, one frame period includes a resetting period P1 in which the reset potential is supplied to the driving transistor and the OLED element, a data writing period P3 in which data is written to the storage capacitor Cst, and a light emitting period P5. In the normal mode, one frame period does not include a stressing period P7.

The driver IC 134 controls the OLED panel in a stress application mode for a predetermined period following activation from a non-displaying state such as a power-off state or a standing-by state to display images. After the predetermined period, the driver IC 134 controls the OLED panel in a normal mode to display images. This configuration reduces the initial brightness drop and further, the power consumption in the OLED display device.

Next, another method of controlling the pixel circuit 500 is described. The example described with reference to FIGS. 6 and 7 applies the stress current from the power line PVDD to the driving transistor. The following example applies the stress current from the data line VDATA to the driving transistor.

Figure 10:
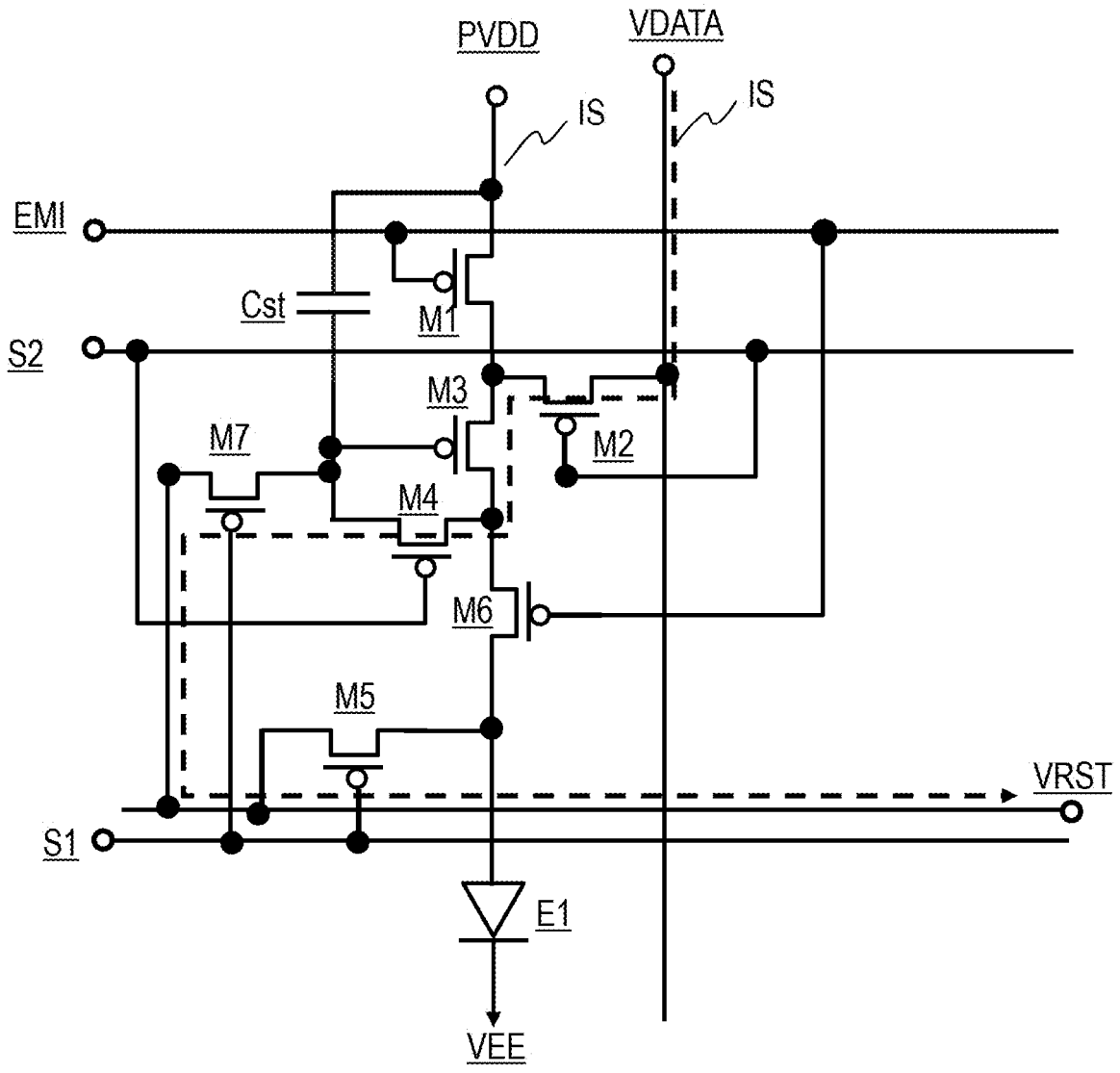
FIG. 10 illustrates a flow of stress current.

FIG. 10 illustrates the flow of the stress current IS in this example. The pixel circuit configuration is the same as the configuration illustrated in FIG. 5. The stress current IS is supplied from the data line VDATA to the driving transistor M3 via the transistor M2. The stress current IS that has passed through the driving transistor M3 flows into the reset line VRST via the transistors M4, M7, and M5.

The driver IC 134 sets the emission control signal EMI to High and sets the selection signals S1 and S2 to Low to apply the stress current IS. Since the selection signals S1 and S2 are Low, the transistors M2, M4, M7, and M5 are ON. The stress current from the data line VDATA flows through these transistors and the driving transistor M3. Since the emission control signal EMI is High, the transistor M6 is OFF. Accordingly, the path of the stress current IS to the OLED element E1 is blocked.

Unlike the example described with reference to FIG. 6, the path illustrated in FIG. 10 cannot be used to supply the stress current within a resetting period. For this reason, it is important that the stressing period does not overlap the other operating periods (the stressing period should be isolated) in order to apply the stress current using the above-described path during a frame period.

To address this issue, the driver IC 134 can apply the stress current to the pixel circuit in a period other than the image displaying period (frame periods), for example. The image displaying period is a period for displaying picture (images) and consists of frame periods. As described above, the frame period consists of a resetting period, a data writing period and a light emitting period. As a result, the stress current is applied to the driving transistor without affecting the image display. The driver IC 134 can supply the stress current using the path described with reference to FIG. 5 in a period other than the image displaying period.

Figure 11:
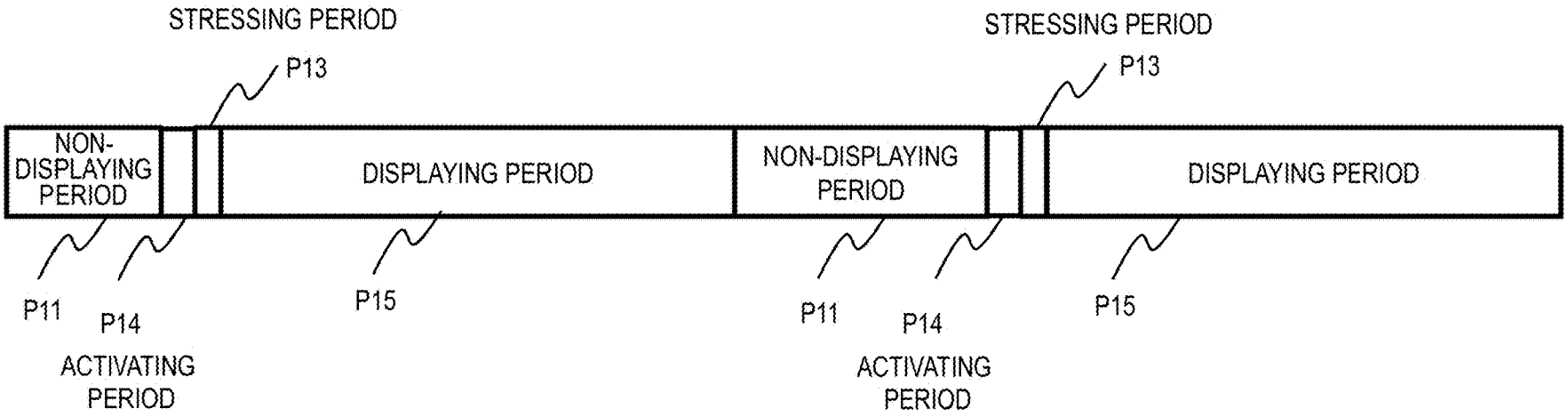
FIG. 11 illustrates an example of applying stress current to a driving transistor in a stressing period between a non-displaying period and a displaying period.

FIG. 11 illustrates an example of supplying stress current to the driving transistor in a period after activation but before a displaying period. Specifically, the stress current is supplied to the driving transistor in a stressing period P13 between a non-displaying period P11 and a displaying period P15.

In an activating period P14, the power supply IC of the display device is activated in accordance with a predetermined sequence in response to an instruction from an external device; the driver IC is activated in accordance with a predetermined sequence in response to a control signal from the power supply IC to start supplying control signals to the scanning circuit of the OLED panel. In a stressing period P13, the driver IC supplies stress current while supplying a voltage corresponding to the black level to the data lines VDATA and control signals to make the emission control signal EMI High and the selection signals S1 and S2 Low to the scanning circuit, as described above.

Figure 12:
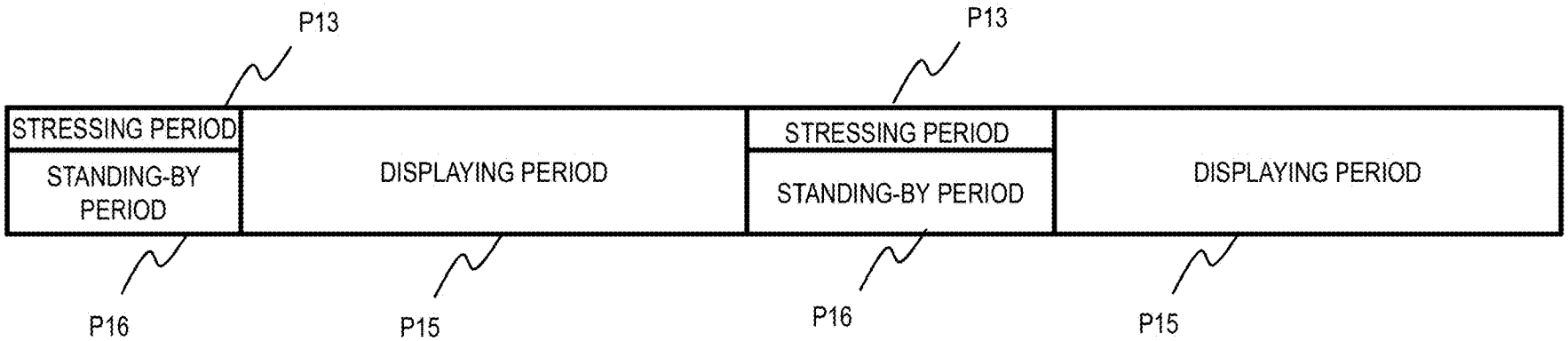
FIG. 12 illustrates an example where a non-displaying period in a standing-by state includes a stressing period.

In another example, the driver IC 134 supplies stress current through the path illustrated in FIG. 10 during a standing-by period P16. FIG. 12 illustrates an example where the standing-by period P16 includes a stressing period P13. The driver IC 134 can supply stress current to the driving transistor during a part of the standing-by period 16. In a standing-by state, displaying images is stopped but the power is being supplied to the driver IC 134 to keep it operable; images can be displayed immediately in response to an instruction from an external device.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:

a pixel circuit; and a control circuit configured to control the pixel circuit, wherein the pixel circuit includes:

a light-emitting element; and a driving thin-film transistor configured to control an amount of current to the light-emitting element, wherein the control circuit is configured to supply a stress current to the driving thin-film transistor during the non-light-emitting period of the light-emitting element but not supply the stress current to the light-emitting element in non-light-emitting periods of the light-emitting element, and wherein the stress current is larger than a maximum current supplied to the light-emitting element during light-emitting periods of the light-emitting element and the stress current is not supplied to the light-emitting element.

2. The display device according to claim 1, wherein the control circuit is configured to apply the stress current to the driving thin-film transistor in an interval between light-emitting periods of the light-emitting element in an image displaying period.

3. The display device according to claim 2, wherein the control circuit is configured to apply the stress current to the driving thin-film transistor when the control circuit is supplying a reset potential to a gate of the driving thin-film transistor.

4. The display device according to claim 1, wherein the control circuit is configured to apply the stress current to the driving thin-film transistor in a period after activation of the display device but before an image displaying period.

5. The display device according to claim 1, wherein the control circuit is configured to supply the stress current to the driving thin-film transistor in a period where the display device is in a standing-by state.

6. The display device according to claim 1, wherein the control circuit has a first control mode and a second control mode to control the pixel circuit, wherein the first control mode is configured to supply the stress current to the driving thin-film transistor in an interval between light-emitting periods in an image displaying period, and wherein the second control mode is configured not to supply the stress current to the driving thin-film transistor.

7. The display device according to claim 6, wherein the control circuit is configured to:

control the pixel circuit in the first control mode in a first period following activation of the display device; and control the pixel circuit in the second control mode after elapse of the first period.

8. A method of controlling a pixel circuit including a light-emitting element and a driving thin-film transistor configured to control an amount of current to the light-emitting element, the method comprising:

supplying a stress current to the driving thin-film transistor during the non-light-emitting period of the light-emitting element but not supplying the stress current to the light-emitting element in non-light-emitting periods of the light-emitting element, and wherein the stress current is larger than a maximum current supplied to the light-emitting element during light-emitting periods of the light-emitting element and the stress current is not supplied to the light-emitting element.

9. The method according to claim 8, wherein the applying a stress current applies the stress current to the driving thin-film transistor in an interval between light-emitting periods in an image displaying period.

10. The method according to claim 8, wherein the applying a stress current applies the stress current to the driving thin-film transistor when a reset potential is being supplied to a gate of the driving thin-film transistor.

* * * * *